US008545073B2

(12) United States Patent
Meyrenaud

(10) Patent No.: US 8,545,073 B2
(45) Date of Patent: Oct. 1, 2013

(54) LIGHTING MODULE AND DEVICE FOR VEHICLE WITH IMPROVED HIGH-BEAM FUNCTION

(75) Inventor: Jean-Luc Meyrenaud, Livry Gargan (FR)

(73) Assignee: Valeo Vision, Bobigny (FR)

( * ) Notice: Subject to any disclaimer, the term of this patent is extended or adjusted under 35 U.S.C. 154(b) by 0 days.

(21) Appl. No.: 13/265,603

(22) PCT Filed: Apr. 15, 2010

(86) PCT No.: PCT/EP2010/055005

§ 371 (c)(1),
(2), (4) Date: Oct. 21, 2011

(87) PCT Pub. No.: WO2010/121948

PCT Pub. Date: Oct. 28, 2010

(65) Prior Publication Data

US 2012/0039083 A1 Feb. 16, 2012

(30) Foreign Application Priority Data

Apr. 21, 2009 (FR) ..... 09 01623

(51) Int. Cl.
*F21V 33/00* (2006.01)

(52) U.S. Cl.
USPC ..... 362/545; 362/311.02; 362/539

(58) Field of Classification Search
USPC ..... 362/249.02, 311.02, 800, 538, 539, 362/545, 297, 298, 304, 346, 347, 299, 300
See application file for complete search history.

(56) References Cited

U.S. PATENT DOCUMENTS

| | | | | |
|---|---|---|---|---|
| 4,914,747 | A | 4/1990 | Nino | |
| 6,152,589 | A * | 11/2000 | Kawaguchi et al. | 362/518 |
| 7,156,544 | B2 * | 1/2007 | Ishida | 362/538 |
| 7,347,600 | B2 | 3/2008 | Albou | |
| 7,604,385 | B2 | 10/2009 | Albou | |
| 7,726,857 | B2 | 6/2010 | Nakada et al. | |
| 2005/0083686 | A1 * | 4/2005 | Yatsuda et al. | 362/230 |
| 2005/0094402 | A1 | 5/2005 | Albou | |
| 2007/0171665 | A1 | 7/2007 | Finch | |
| 2008/0137358 | A1 | 6/2008 | Albou | |
| 2008/0247185 | A1 | 10/2008 | Nakada et al. | |
| 2009/0097268 | A1 * | 4/2009 | Mochizuki | 362/538 |

FOREIGN PATENT DOCUMENTS

| | | |
|---|---|---|
| EP | 1500869 | 1/2005 |
| EP | 1528312 | 5/2005 |
| EP | 1666787 | 6/2006 |
| EP | 1978297 | 10/2008 |

* cited by examiner

*Primary Examiner* — Laura Tso
(74) *Attorney, Agent, or Firm* — Jacox, Meckstroth & Jenkins

(57) ABSTRACT

A lighting module notably for motor vehicles comprising a first concave reflector comprising a first and a second focal point, a second concave reflector comprising a first and a second focal point, the first and the second reflectors having a truncated circumference such that the reflecting face of the first reflector is oriented towards that of the second reflector, a shield between the first and the second reflectors, an optical element comprising a first focal point situated in a plane perpendicular to the optical axis of the module and passing through the cut-off edge, the cut-off edge being situated at the second focal point of the first reflector and at the second focal point of the second reflector.

22 Claims, 6 Drawing Sheets

LIGHTING MODULE AND DEVICE FOR VEHICLE WITH IMPROVED HIGH-BEAM FUNCTION

CROSS-REFERENCE TO RELATED APPLICATIONS

This application claims priority to PCT Application PCT/EP2010/055005 filed Apr. 15, 2010 and also to French Application No. 0901623 filed Apr. 21, 2009, which applications are incorporated herein by reference and made a part hereof.

BACKGROUND OF THE INVENTION

1. Field of the Invention

The invention relates to a lighting module notably for motor vehicles, the lighting module comprising a first lighting function of the low-beam type with an essentially horizontal directivity of the beam. More particularly, the invention relates to a lighting module comprising a second lighting function of the high-beam type provided by an additional beam completing the high-beam beam.

2. Description of the Related Art

A lighting module comprising two reflectors of the ellipsoidal type is known from the Patent document U.S. Pat. No. 4,914,747. These two reflectors correspond to semi-ellipsoids and are superposed with their reflecting surfaces oriented towards one another, i.e. in an opposing fashion. The module comprises a specific light source for the upper reflector and a common light source for the two reflectors, the specific light source being situated at the focal point of the upper reflector in order to participate in the formation of an illuminating beam of the low-beam type and the common light source being situated at the focal point of the lower reflector in order to participate in the formation of an illuminating beam of the high-beam type. A horizontal shield with a cut-off edge is provided close to the second focal points of the two reflectors. A lens is disposed after the shield with its optical axis coinciding with the optical axis of the module. The lens is disposed in such a manner that its first focal point is close to the second focal point of the reflectors. In order to form the low beam, the light rays emitted by the specific light source of the upper reflector are reflected by the internal surface of the reflector approximately towards the second focal point of the reflector. A part of the rays pass in front of the cut-off edge of the shield. These rays encounter the lens within its lower half and are then refracted upwards. The shield blocks a part of the rays which otherwise would encounter the lens within its lower half and would form the upper part of the beam emitted after passage through the lens. The low beam thus has an upper limit referred to as cut-off. In order to form the high beam, the light rays emitted by the common light source are reflected by the upper reflector towards the lower part of the upper half of the lens and also by the lower reflector towards the second focal point of the reflector. In a similar manner to the rays emitted by the specific light source of the upper reflector, a part of the rays pass in front of the shield and encounter the upper half of the lens. Another part of the rays is reflected by the shield or reflected by a reflecting part of the latter, so as to then be refracted by the lower part of the lens in order to form the upper part of the beam, which has a lower cut-off. The position of the shield therefore determines the cut-off of the upper part of the beam, which is added to the lower part of the beam coming from the lower reflector. This superposition allows a beam to be obtained that will provide the high-beam function. This module exhibits a region of less intense illumination at the cut-off in the beam of the high-beam type and corresponds to a particular embodiment of U.S. Pat. No. 4,914,747. Furthermore, the lower part of the beam is a particular case because it originates from an unfocussed source.

What is needed, therefore, is a module that provides an improved lighting function.

SUMMARY OF THE INVENTION

The aim of the present invention is to obtain a compact device allowing participation in the generation of two beams.

The subject of the present invention is a lighting module notably for motor vehicles comprising:

- a first concave reflector comprising at least a first and a second focal point aligned on an optical axis of the first reflector, in such a manner that a majority of light rays leaving from this first focal point and reflected by the first reflector converge towards this second focal point;
- a second concave reflector and comprising at least a first and a second focal point aligned on an optical axis of the second reflector, in such a manner that a majority of light rays leaving from this first focal point and reflected by the second reflector converge towards this second focal point, the first and the second reflectors having a truncated circumference such that, since the optical axes of the first and of the second reflectors are notably globally oriented in the same direction, the reflecting face of the first reflector is oriented towards that of the second reflector;
- a shield disposed in a plane about between the first and the second reflectors, the shield having a first face facing the reflecting surface of the first reflector and a second face facing the reflecting surface of the second reflector, the shield comprising a cut-off edge joining its first and its second face;
- an optical element comprising a first focal point situated in a plane perpendicular to the optical axis of the module and passing through the cut-off edge;

the cut-off edge is situated at the second focal point of the first reflector and at the second focal point of the second reflector. Advantageously, the first reflector of the first module comprises two intersecting reflection surfaces, each being a surface of revolution described by an ellipse in a half-plane having a first and a second focal point aligned on an optical axis, the optical axes of the two surfaces of revolution intersecting at their second focal points.

A compact module is thus obtained that enables two complementary beams to be emitted. This is achieved by positioning a first light source at a first focal point of the first reflector, the first light source only illuminating in the direction of the first reflector, and by positioning a second light source at the first focal point of the second reflector, the second light source only illuminating in the direction of the second reflector, so that the beam generated by the first reflector will exhibit a cut-off with a shape approximately complementary to that of the beam generated by the second reflector. A complete beam without cut-off is thus obtained that is relatively uniform when the two sources are lit, and a beam with a sharp cut-off when only one of the sources is lit. The cut-off is sharp because the cut-off edge is in focus, since it is positioned at the focal point of the corresponding reflector. With this first reflector having two reflection faces, the use of two light sources in this module can be made compact. In this case, a first light source is positioned at the first focal point of one of the reflection surfaces of the first reflector, and a second light source is positioned at the first focal point of the other reflection surface of the first reflector. Thus, a beam generated by the first reflector can be obtained with a cut-off shape that is approximately complementary to that of the beam generated by the second reflector, by means of a first reflector with two light sources and of an optical element, such as a lens, common to the two reflecting faces associated with the two light sources. A gain in compactness is thus obtained. This is particularly advantageous when the light sources are light-emitting diodes. This notably allows two sources of lower power to be employed instead of a single one.

The optical axes of the first and of the second reflectors are notably oriented in the same general direction. In other words, when the optical axis of the first reflector is oriented towards the front of the vehicle, the optical axis of the second reflector is also oriented towards the front of the vehicle.

Thus, for example, if the first reflector is positioned at the top, when it is installed in a vehicle, it can generate a beam of the low-beam type, or participate in a low-beam headlight, when the first source is switched on. In order to switch to high-beam headlights, the second light source is switched on and the beam generated by the second reflector then completes that of the first reflector, in order to form a high beam.

A second subject of the invention is a lighting module notably for motor vehicles comprising:

- a first concave reflector comprising at least a first and a second focal point aligned on an optical axis of the first reflector, in such a manner that a majority of light rays leaving from this first focal point and reflected by the first reflector converge towards this second focal point;
- a second concave reflector and comprising at least a first and a second focal point aligned on an optical axis of the second reflector, in such a manner that a majority of light rays leaving from this first focal point and reflected by the second reflector converge towards this second focal point, the first and the second reflectors having a truncated circumference such that, since the optical axes of the first and of the second reflectors are notably oriented in the same general direction, the reflecting face of the first reflector is oriented towards that of the second reflector;
- a shield disposed in a plane about between the first and the second reflectors, the shield having a first face facing the reflecting surface of the first reflector and a second face facing the reflecting surface of the second reflector, the shield comprising a cut-off edge joining its first and its second face;
- an optical element comprising a first focal point situated in a plane perpendicular to the optical axis of the module and passing through the cut-off edge;

the cut-off edge is situated at the second focal point of the first reflector and at the second focal point of the second reflector. Advantageously, the shield comprises at least at the cut-off edge a curved profile in a plane perpendicular to the optical axis of the module, in such a manner as to influence in a corresponding manner the cut-off of a beam coming from one of the reflectors.

A compact module enabling two complementary beams to be emitted is thus obtained. This is achieved by positioning a first light source at a first focal point of the first reflector, the first light source only illuminating in the direction of the first reflector, and by positioning a second light source at the first focal point of the second reflector, the second light source only illuminating in the direction of the second reflector, so that the beam generated by the first reflector will exhibit a cut-off with a shape approximately complementary to that of the beam generated by the second reflector. A complete beam without cut-off is thus obtained that is relatively uniform when the two sources are lit, and a beam with a sharp cut-off when only one of the sources is lit. The cut-off is sharp because the cut-off edge is in focus, since it is positioned at the focal point of the corresponding reflector.

The optical axes of the first and of the second reflectors are notably oriented in the same general direction. In other words, when the optical axis of the first reflector is oriented towards the front of the vehicle, the optical axis of the second reflector is also oriented towards the front of the vehicle.

Preferably, the curved profile is centered globally on the optical axis of the module. When the curvature is convex towards the top, the first reflector being oriented upwards, this module allows a beam with a horizontal upper cut-off, with the exception of a curved, or rounded, depression, oriented downwards, to be obtained. This allows this beam to be superposed onto a beam having a different cut-off in the center, for example a cut-off of the type oblique cut-off of a low beam, without non-uniformity due to a slight offset of the cut-offs at the center of the beams.

Preferably, the curved profile is present on the two opposing reflecting surfaces of the beam bender.

Preferably, the curved profile is limited to a central part of the shield, the rest being essentially flat.

Preferably, according to the invention, the first face of the shield and the second face of the shield meet at a cut-off edge and the second focal point of the first and of the second reflector coincide at a second common focal point, the cut-off edge being positioned at the second common focal point.

The cut-off effected by such a module has the feature that it thus overcomes the loss or non-uniformity resulting from the non-zero thickness of the shield and from the roundness of its cut-off edge. Indeed, the cut-off of the beam from the first reflector thus practically coincides with the cut-off of the beam from the second reflector. A uniform high beam can for example be obtained.

Preferably, according to one embodiment of the invention, at least one of the first and second faces of the shield is reflecting. A better recovery of the light intensity is thus obtained. Indeed, the rays encountering the reflecting surface of the shield will be returned towards the front and participate in the formation of the beam. Thus, a beam with cut-off will be obtained like with a shield without reflecting surface but more intense. Shields with reflecting surfaces will henceforth be referred to as beam bender.

Preferably, according to one embodiment of the invention, the shield is a thin element whose complex profile runs in a decreasing fashion from the cut-off edge towards the back of the module in such a manner as to form a complex surface.

Preferably, according to one embodiment of the invention, the complex surface corresponds to a centered thin strip of the beam bender.

Preferably, the cut-off edge has an essentially straight profile when it is projected into the general plane of the beam bender.

Preferably again, the module according to the present invention comprises a first light source situated approximately at the first focal point of the first reflector and a second light source situated approximately at the first focal point of the second reflector, the first light source only illuminating in the direction of the first reflector and the second light source only illuminating in the direction of the second reflector. Preferably, the first light source comprises a light-emitting diode, or LED, emitting in a general direction oriented towards the first reflector, and the second light source comprises an LED emitting in a general direction oriented towards the second reflector. The LEDs comprise a substrate carrying a semiconductor element which generates the light when it is supplied with electrical current. The LEDs generally emit a cone of light oriented from one side of the half-plane containing the substrate, the side being that where the semiconductor element is situated. The axis of this cone corresponds to the general emission direction of the LED.

According to a particularly advantageous embodiment, the light sources are carried by the shield, the first light source on the first face of the shield and the second on the second face of the shield.

The invention also relates to a lighting device notably for motor vehicles comprising:

- a first lighting module comprising a first lighting function of the low-beam type;
- a second lighting module according to the present invention;

the first and second modules being disposed next to one another in such a manner that their beams converge.

This device allows the errors in the central part of the beam projected in high-beam mode to be minimized. In addition, the superposition of the beams coming from the various modules allows a certain freedom in the precision of adjustment in a horizontal plane owing to the overlap of the central raised part of the beam of the first module by the central part of the beam bulging downwards of the second module.

According to a preferred variant embodiment of this lighting device:

- the first module is a module according to the present invention, the cut-off edge of the first module having two straight parts offset with respect to one another by a protrusion in the central part of this cut-off edge, in order to form, in association with the rays reflected by the first reflector of the first module, a first beam of the low-beam type having an oblique cut-off portion;
- the second module is a module according to the present invention, the curved profile of the cut-off edge being centered generally on the optical axis of the second module, in order to form, in association with the rays reflected by the first reflector of the second module, a second beam having an upper cut-off with a curved profile oriented downwards;

the first and second modules being oriented in such a manner that the oblique portion of the cut-off of the first beam converges towards the curved profile of the beam of the second beam.

According to a preferred variant embodiment of this lighting device, the first lighting module comprises a second lighting function of the high-beam type where an additional beam completes the beam for the first function.

According to a preferred variant embodiment of this lighting device, the second lighting module comprises a cut-off edge of constant thickness such that the second reflector of the second module allows a third beam to be generated that exhibits a lower cut-off with a complementary curvature to the curvature of the upper cut-off of the second beam.

According to a preferred variant embodiment of this lighting device, the first reflector of the first module comprises several, preferably two, reflection units, each of the units having a light source situated at a first focal point of the reflection unit, the optical axes of the reflection units intersecting at their focal points of convergence.

According to a preferred variant embodiment of this lighting device, the first reflector and/or the second reflector of the first module comprises a reflection surface of revolution of ellipsoidal cross-section.

According to a preferred variant embodiment of this lighting device, the first reflector of the first module comprises two intersecting reflection surfaces, each being a surface of revolution described by an ellipse in a half-plane having a first and a second focal point aligned on an optical axis, the optical axes of the two surfaces of revolution intersecting at their second focal point.

According to an advantageous embodiment of the invention, the first lighting module comprises a first upper half-plane reflector with at least a first light source; a second lower half-plane reflector with a second light source, the second reflector opposing the first reflector; the focal points of convergence of the light rays of the first and second reflectors being at least approximately coincident in a plane corresponding to the junction of the two reflectors; a beam bender situated in the junction plane of the reflectors and with a cut-off edge situated approximately at the focal points of convergences of the reflectors; the first lighting function being provided by the light source or sources of the first reflector, the second lighting function being provided by the light source or sources of the first and second reflectors.

According to an advantageous embodiment of the invention, the first reflector comprises two intersecting reflection surfaces, each being a surface of revolution described by an ellipse in a half-plane, the axes of revolution of the two surfaces of revolution intersecting at the focal points of convergence.

The invention also relates to a lighting device notably for motor vehicles comprising: a first lighting module comprising a first lighting function of the low-beam type with an essentially horizontal cut-off of the emitted beam, the cut-off having a protrusion on its central part; a second lighting module distinct from the first and providing a lighting function designed to complete the beam of the first module providing a lighting function of the high-beam type, the lighting function of the second module comprising a low cut-off such that it overlaps the beam of the first module at least in its central part.

The low cut-off of the beam of the second module can be provided by a shield with a suitable profile positioned close to the focal point of convergence of the rays coming from the module. The profile of the cut-off is advantageously essentially horizontal with a central part that is slightly bulging downwards in such a manner as to overlap the protrusion in the cut-off of the first module.

Another subject of the invention relates to a lighting unit for generating a light beam with cut-off, notably for a low-beam headlight for motor vehicles, this lighting unit comprising:

- a first reflector comprising at least two reflection faces, each having a first focal point and a second focal point aligned on an optical axis, each face being capable of reflecting the light rays leaving from its first focal point towards its second focal point, the optical axes of the two reflection faces intersecting at their second focal points;
- a shield configured for creating a cut-off in the light beam generated by the lighting unit;
- an optical element comprising a first focal point situated on the cut-off edge of the shield, the reflection faces, the shield and the optical element being configured in such a manner as to allow the generation of a light beam with cut-off.

This unit can thus use two light sources in this module, while still being compact. In this case, a first light source is positioned at the first focal point of one of the reflection surfaces of the first reflector, and a second light source is positioned at the first focal point of the other reflection surface of the first reflector. A beam with cut-off can thus be obtained by means of a first reflector with two light sources with an optical element, such as a lens, common to the two reflecting faces associated with the two light sources. This is particularly advantageous when the light sources are light-emitting diodes. This notably allows two light sources of lower power to be used, instead of a single one.

Preferably, the optical element of the lighting unit is a converging lens.

Preferably, in this lighting unit, each reflection face of the first reflector is comprised within a portion of ellipsoid, the two portions of ellipsoids intersecting along a line of separation separating the two reflection faces. The shape of this portion may not strictly be that of an ellipsoid and may approximate to an ellipsoid. Advantageously, the two reflection faces meet at the line of separation.

Preferably, in this lighting unit, the angle between the optical axes of the two reflection faces is an angle in the range between 20 and 40 degrees, preferably between 25 and 37 degrees, notably 31 or 35 degrees. These values allow the quantity of light focused by the reflectors to be improved.

Preferably, this lighting unit comprises a first light-emitting diode positioned at the first focal point of one of the reflection faces and a second light-emitting diode positioned at the first focal point of the other reflection face. According to one exemplary embodiment, each light-emitting diode comprises a reference axis. Preferably, the angle between the reference axes of the light-emitting diode is in the range between 20 and 30 degrees. This interval of values allows more freedom in the positioning of the LEDs. This advantageously means that, in the lighting unit, these reference axes of the light-emitting diode can form an angle between them that is different from the angle formed between the optical axes of the reflection faces of the first reflector. For example, this angle between the reference axes of the LEDs can be 26 degrees, whereas that between the optical axes of the reflection faces of the first reflector is 31 or 35 degrees. The reference axes can correspond, for these LEDs, to the axis passing through the corresponding LED and perpendicular to one of the large sides of the emitting surface of the LED, this emitting surface being rectangular.

Advantageously, the light emitting surfaces of the light-emitting diode are substantially in a plane passing through the optical axis of the lighting unit. Preferably, their center is in the plane passing through the optical axis of the lighting unit, generally corresponding to the optical axis of the lens.

This lighting unit can be used in a module previously described. A lighting module according to the first subject of the invention can thus be one in which the first reflector, the shield and the optical element are a lighting unit such as previously described. Advantageously, the second reflector of the module comprises a light-emitting diode, situated at the first focal point of the second reflector and situated underneath the optical axis, notably 11 mm below the optical axis.

In the present invention, the reflective properties of the reflecting surfaces preferably result from a coating of reflecting material deposited onto a part providing the desired shape of the reflector, for example, by aluminizing of a reflector with a generally elliptical shape.

Other features and advantages of the invention will become apparent hereinafter in the detailed description of the embodiments of the invention, presented by way of non-limiting example.

BRIEF DESCRIPTION OF THE ACCOMPANYING DRAWINGS

Figure 1:
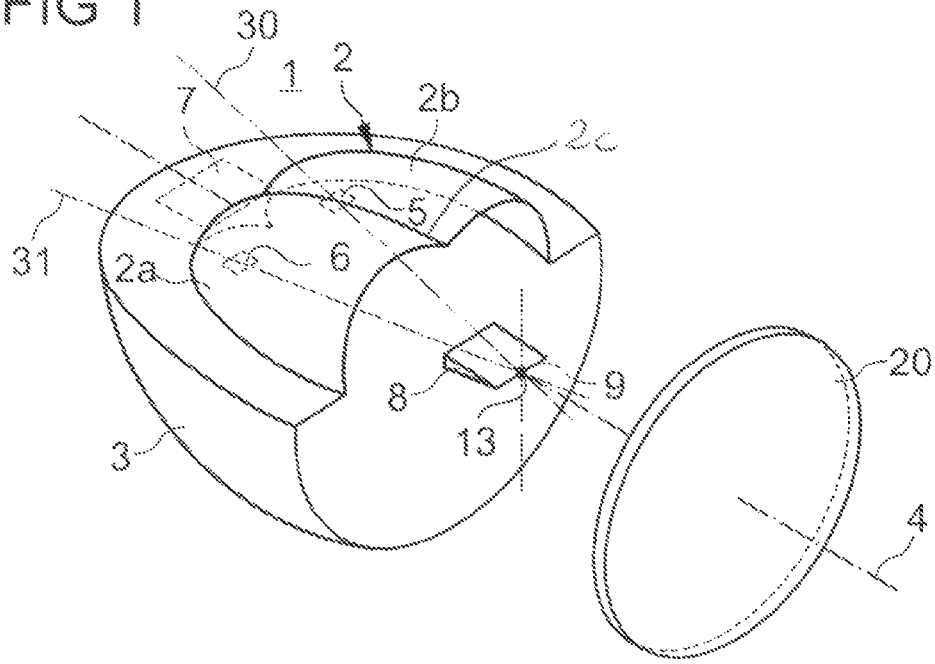
FIG. 1 is a schematic perspective view of a lighting module with a beam bender having a cut-off edge to provide the emitted beam with a cut-off profile of the low-beam type, sometimes referred to as "dipped-beam headlights"
Figure 2:
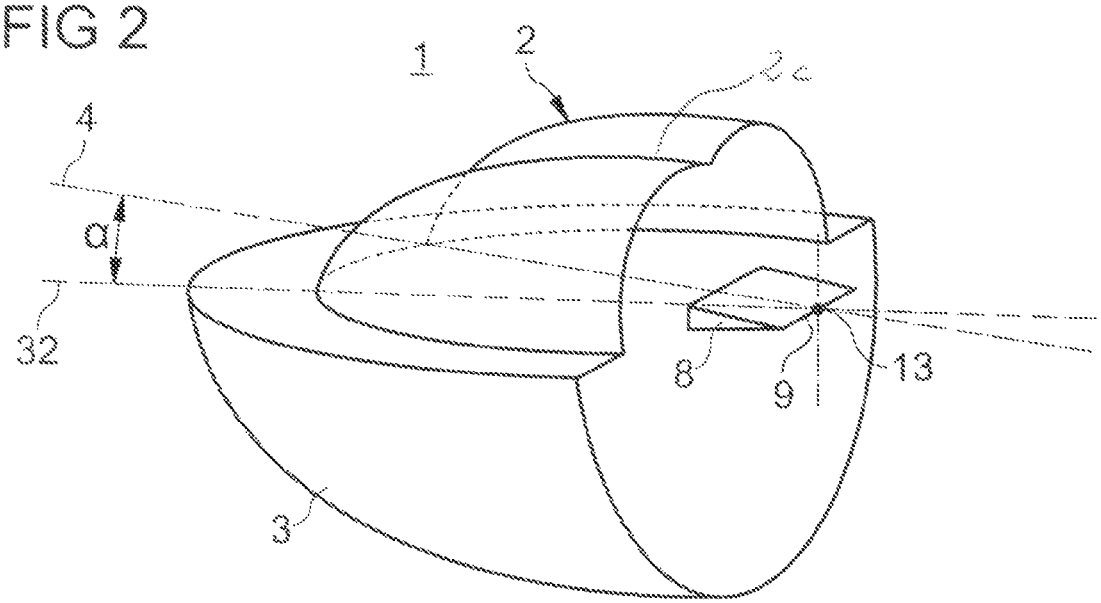
FIG. 2 is a schematic perspective view from another angle of the module in FIG. 1.
Figure 6:
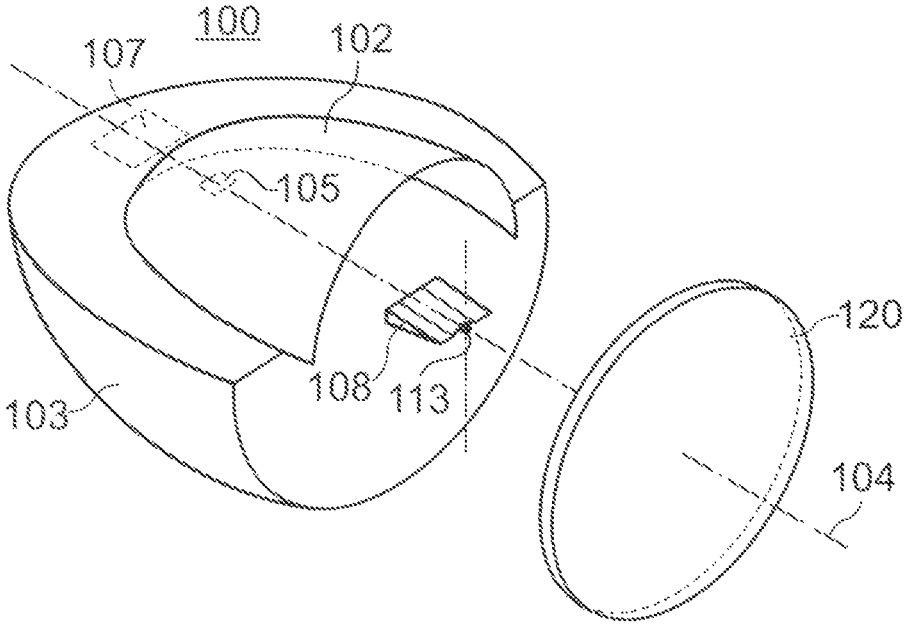
FIG. 6 is a schematic perspective view of a lighting module according to the invention.
Figure 7:
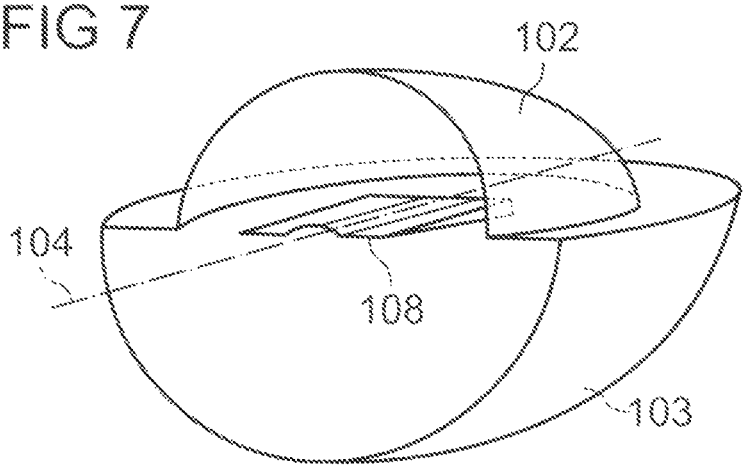
FIG. 7 is a schematic perspective view from another angle of the module in FIG. 6.
Figure 11:
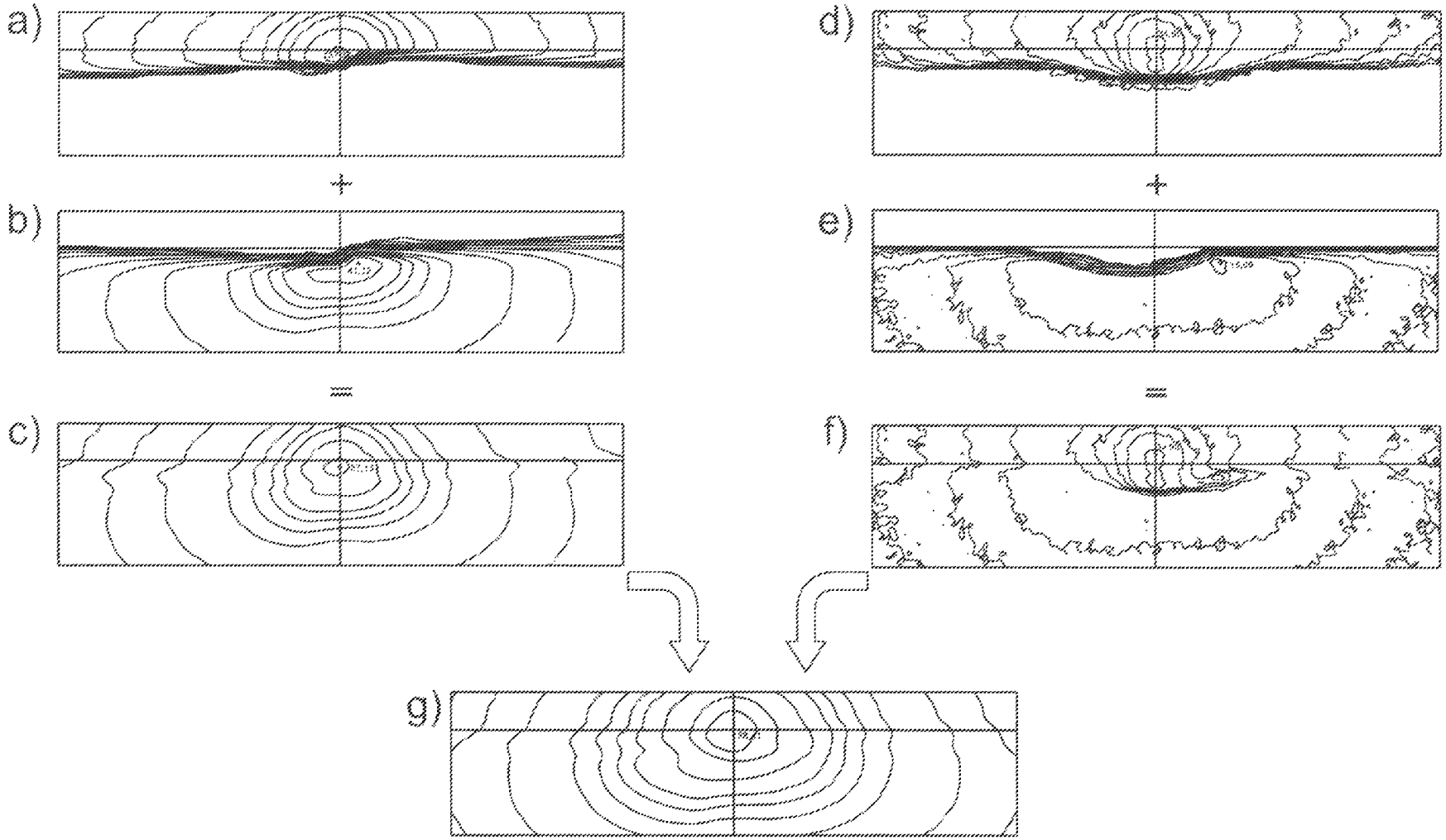
Figure 12:
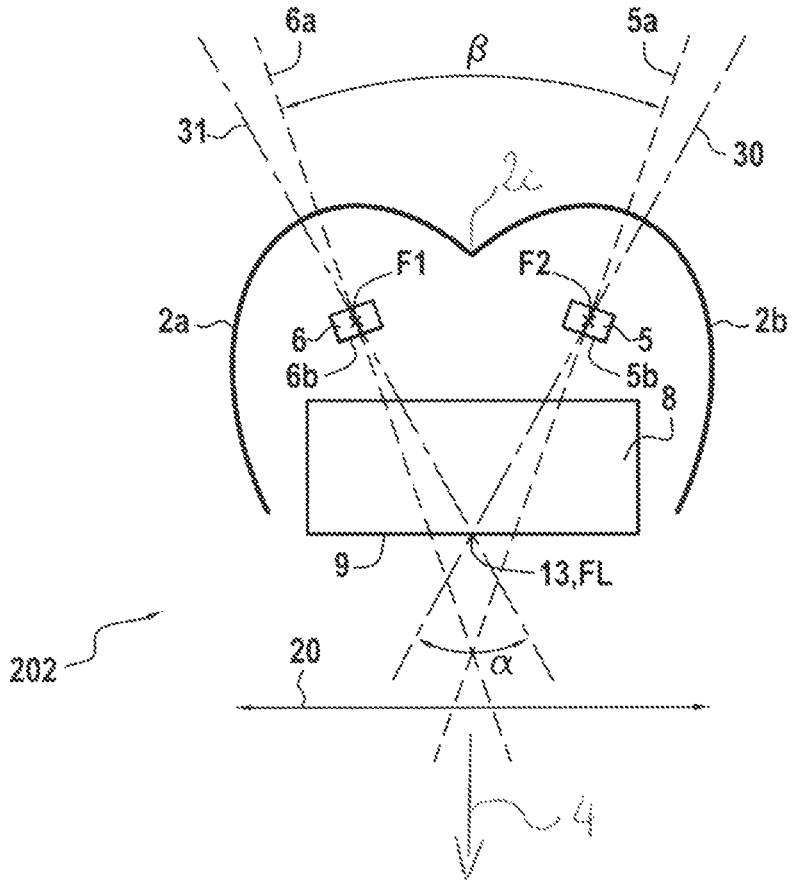

FIG. 11 illustrates by isolux curves the recording at a distance of 25 meters of the beams from the lower reflector (a) and upper reflector (b) and their superposition (c) for the module according to FIGS. 1 and 2, together with the beams from the lower reflector (d) and upper reflector (e) and their superposition (f) for the module according to FIGS. 6 and 7. The section (g) in FIG. 11 illustrates the superposition of the complete beams (c) and (f) for the two modules; and FIG. 12 illustrates a lighting unit according to the present invention.

DETAILED DESCRIPTION OF THE PREFERRED EMBODIMENTS

The embodiments of the invention are illustrated in the figures and described hereinafter with respect to an installation position for the device as a headlamp unit on a vehicle. This type of application, although it is the most widespread, should not be seen as limiting in that the terms employed, such as "horizontal", "vertical", "top", "bottom", "upper", "lower" for example, with a view to describing the positions of the various elements are not absolute, but rather to be interpreted in a relative manner describing the positions of the elements with respect to their disposition in the figures. The lighting devices described could be installed in other positions and/or for other applications. In addition, the relative positions of the various optical elements such as the light sources, the reflectors and the lenses expressed for the simplicity of understanding by alignment of the optical axes and/or correspondence of the respective focal points are not to be interpreted in an exact manner in that small variations could be envisaged or may even be desirable with a view, amongst others, to correcting the imperfect nature and certain optical aberrations of the optical elements or to obtaining certain additional effects. The beam benders shown in some figures of the application have purposely been magnified for reasons of clarity of presentation.

FIG. 1 is a schematic perspective view of a motor vehicle headlamp lighting module. The lighting module 1 comprises a first half-plane upper reflector 2 formed from a double reflecting concave surface. Each of these surfaces 2*a* and 2*b* is a surface of revolution of a section of ellipse about an axis of symmetry. These two surfaces intersect in the vertical median plane of the module 1, thus forming an upper reflector in the form of a double bulb. The two axes of revolution or of symmetry 30 and 31 of the surfaces, respectively 2*b* and 2*a*, of the reflector intersect in such a manner that the beams reflected by these surfaces converge. A light source 5, 6 of the light-emitting diode or LED type is located approximately at the first focal point of each surface 2*b*, 2*a* forming the upper reflector 2. Given the symmetry of revolution of these surfaces, the first focal point of each surface is located on the axis of revolution. The second focal points of the surfaces are also situated on the respective axes of revolution. The surfaces 2*a* and 2*b* are oriented in such a manner that these second focal points mutually correspond at the point of intersection 13 of the two axes.

The module 1 also comprises a lower reflector 3, also half-plane, formed from a concave reflecting surface described, just as for each of the double surfaces of the upper reflector, by a section of ellipse in rotation about an axis of rotation 32 or of symmetry. A light source 7, also of the LED type, is positioned at the first focal point of the lower reflector. The reflector is dimensioned and configured with respect to the upper reflector in such a manner that its second focal point corresponds to the second focal point of the upper reflector.

The main optical axis 4 of the module 1 passes through the plane that contains the axes of symmetry 30, 31 of the reflection surfaces 2*b* and 2*a* of the first reflector 2.

It should be noted that the internal reflecting surfaces of the reflectors may not be perfectly elliptical and could have one or more specific or complex profiles with a view to optimizing the light distribution in the illuminating beam. This can imply that the surfaces 2*a* and 2*b* of the first reflector 2 or the surface of the second reflector 3 might not have a perfect symmetry of revolution.

An essentially flat interface is included between the first reflector 2 and the second reflector 3 so as to provide the link between them and also to support the light sources 5, 6 and 7. These light sources are designed to emit in a half-plane, the sources 5 and 6 in an upper half-plane and the source 7 in a lower half-plane.

This type of light source has the advantageous feature of being particularly compact to the extent of being able to be considered as approximately equivalent to a point source. Other types of known light source may however also be considered.

The light rays emanating from the light sources 5, 6 and 7 roughly equivalent to point sources are reflected by the reflecting surfaces of the reflectors 2 and 3 and all converge towards the second common focal point 13 of the reflector. In reality, the light sources are not point sources and the form of the reflecting surfaces is not necessarily perfectly elliptical to the extent that the rays reflected do not all converge towards the second focal point 13 but rather towards a region close to the second focal point 13.

A reflecting optical element 8, commonly referred to as "beam bender", is disposed on the optical axis 4 with its front edge, referred to as "cut-off edge" 9, close to the second focal point 13. This thin and essentially flat beam bender 8 comprises an upper reflecting surface and a lower reflecting surface. Consequently, the light rays emanating from the reflectors 2 and 3 converging towards the second focal point 13 and which encounter a surface of the beam bender 8 are reflected.

A lens 20 is provided on the optical path of the device. This lens of the plano-convex type has its focal point corresponding to the second focal point 13 of the reflectors and its optical axis coinciding with the optical axis 4 of the module such that the light rays coming from the focal point 13 are essentially transmitted parallel to the optical axis 4. Other types of converging lens may be envisaged, such as for example a biconvex lens or else of the converging concavo-convex type. A reflector of the paraboloidal mirror type may also be envisaged. In this case, its optical axis would essentially be perpendicular to or, at the very least, intersecting with the axis 4, and its focal point would approximately coincide with the focal point 13. Such a reflector would then reflect the light rays in a direction essentially parallel to its optical axis, in other words in a direction perpendicular to the optical axis 4 or along an axis intersecting with the latter.

FIG. 2 is another schematic view of the module in FIG. 1 from a different angle. This view illustrates the inclination of the upper reflector 2 with respect to the lower reflector 3. As previously seen, the axes of revolution of the surfaces 2*a* and 2*b* of the upper reflector, together with the general optical axis 4 of the module, are coplanar. In contrast, the axis of revolution of the lower reflector 3 forms an angle $\alpha$ with the general optical axis 4 of the module 1. This angle is quite small, typically a few degrees and is essentially due to the fact that the beam bender—ideally infinitely thin—actually has a certain thickness. The beam bender in fact has a triangular cross-section in a longitudinal and vertical median plane.

Figure 3:
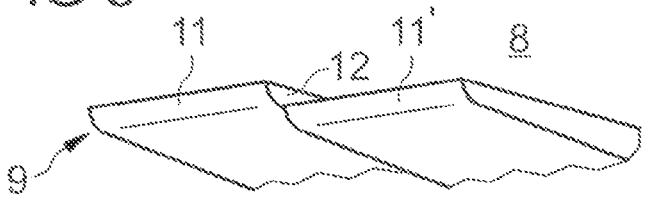
FIG. 3 is a perspective view of the cut-off edge of the beam bender of the module in FIGS. 1 and 2.
Figure 5:
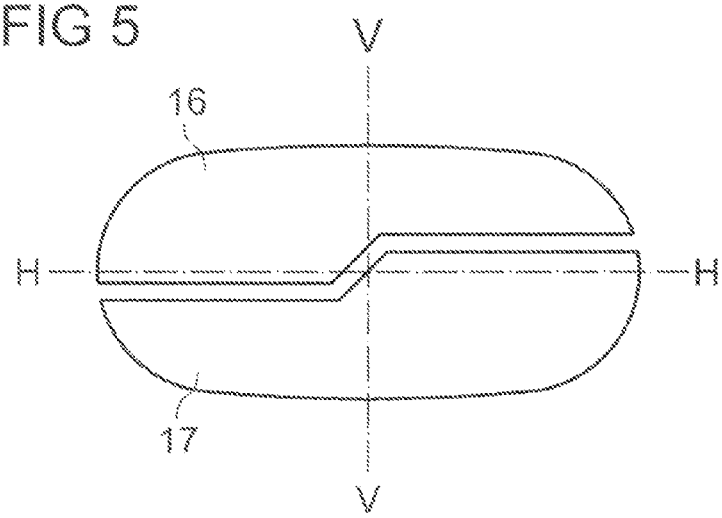
FIG. 5 illustrates the footprint of the beams coming from the upper and lower reflectors, respectively, of the module in FIGS. 1 and 2.

The beam bender is better shown in FIG. 3 which is a magnified perspective view of the cut-off edge of the latter. The beam bender 8 has a finite thickness that increases from the cut-off edge 9 towards its back end. The cut-off edge 9 exhibits a protrusion 12 approximately in its central part, in other words the part positioned around the optical axis 4. The upper surface and the lower surface on either side of this protrusion 12 are essentially flat. The protrusion thus constitutes a discontinuity in the profile of the cut-off edge. The cut-off edge 11 on the right-hand side when viewed from the reflectors towards the lens, in other words the left-hand side on the representation in FIG. 3, is slightly raised with respect to the opposite side 11'. The cut-off effected by the beam bender will therefore cut off more rays coming from the right-hand parts of the reflectors, in other words the rays that will subsequently form the left-hand part of the beam projected by the lens 20. This left-hand part will thus exhibit a lower cut-off than the right-hand part of the beam, the protrusion creating an oblique section. This allows a cut-off of the low-beam type to be obtained as shown in FIG. 5.

Figure 4:
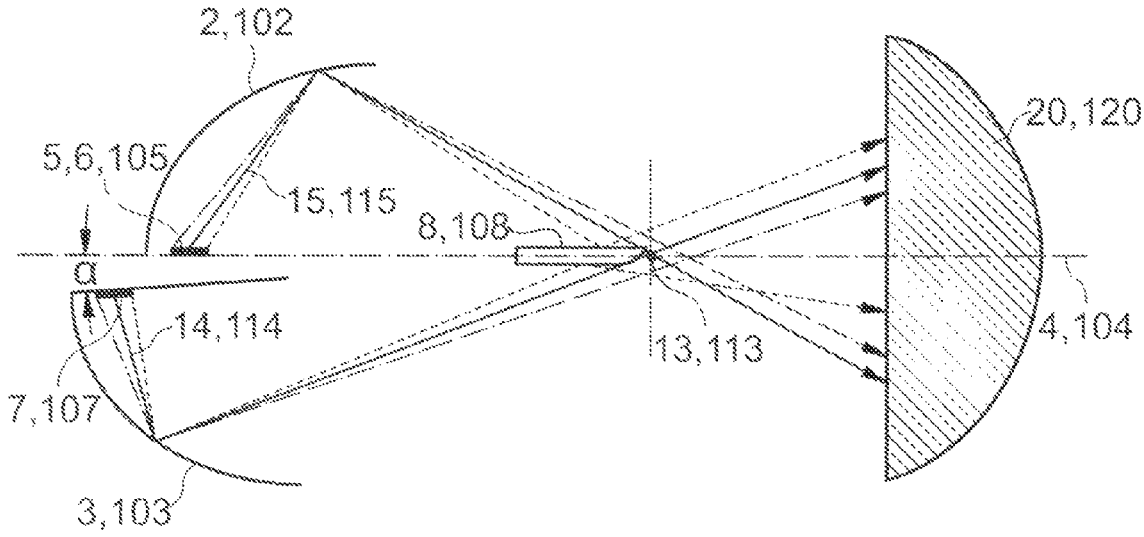
FIG. 4 is a cross-sectional view of a lighting module such as that in FIGS. 1 and 2 or again in FIGS. 6 and 7.

FIG. 4 is a schematic plan and cross-sectional view through a median plane of the module in FIGS. 1 and 2. The aim of this figure is to illustrate the role of the beam bender and of the beam cut-off that it applies. One of the upper light sources 5 or 6 is shown here, together with the profile of the corresponding reflecting surface. This part therefore corresponds to a cross-section through a longitudinal median plane of one of the reflecting surfaces 2*a*, 2*b* forming the upper reflector 2. The lower light source 7 is also shown here together with the profile of the corresponding reflecting surface of the lower reflector 3. The beam bender 8 with a wedge-shaped cross-section is also shown here.

The light ray 15 emitted from the first focal point of the first reflector by the upper light source 5 or 6 is reflected by the reflecting surface of the upper reflector towards the second focal point 13. Since the light source is not a point source, it also emits light rays that are slightly off-axis (shown as dashed lines) which, after reflection by the reflecting surface, will not converge exactly towards the second focal point 13. Thus, certain rays will pass through the focal point and will be refracted by the lens 20 parallel to the global optical axis 4. These rays will correspond to the upper cut-off of the lower beam 17 emitted by the module 1 and shown in FIG. 5. Other rays pass in front of the cut-off edge 9 and travel towards the lower half of the lens. Since they pass above the focal point 13, the lens 20 will refract them downwards. These rays will therefore correspond to the lower part of the beam 17 situated below the cut-off. Other rays encounter the upper reflecting surface of the beam bender and are reflected towards the upper half of the lens. Since these rays therefore also pass above the focal point 13, the lens 20 will also refract them downwards. These rays will therefore complete the lower part of the beam 17 situated below the cut-off. It is therefore the position of the cut-off edge that is determinant for the cut-off or upper limit of the beam.

The upper light sources 5 and 6 associated with the upper reflector 2 provide the lighting function of the low-beam type, in other words a lighting function with an upper cut-off of the projected beam. The simplified footprint 17 of this lower illuminating beam is shown in FIG. 5 (this footprint is typically a projection of the beam at 25 meters). The axis H-H corresponds to the horizontal axis and the axis V-V corresponds to the vertical axis. This footprint does comprise a generally horizontal cut-off with however a protrusion or step generated by the protrusion 12 of the cut-off edge 11 of the beam bender 8. This cut-off profile is a legal requirement in order to limit the dazzling of the drivers coming the other way.

The lower light source 7 and the lower reflector 3 operate in the opposite sense with respect to the combination of the upper reflector 2 and the sources 5 and 6. Thus, a light ray 14 emitted from the first focal point of the lower reflector 3 by the lower light source 7 is reflected by the reflecting surface of the lower reflector 3 towards the second focal point 13. Certain rays will pass through the focal point 13 and will be refracted by the lens 20 parallel to the global optical axis 4. These rays will correspond to the lower cut-off of the upper beam 16 emitted by the module 1, shown in FIG. 5. Some other rays pass in front of the cut-off edge 9 to reach the upper part of the lens 20, while others encounter the lower reflecting surface of the beam bender 8 and are reflected towards the lower half of the lens. These rays therefore pass above the focal point 13 and the lens 20 will refract them upwards; they correspond to the part of the upper beam 16 situated above the lower cut-off.

The lower light source 7 provides the lighting function of the high-beam type in combination with the upper light sources 5 and 6. The cut-off edge 9 has a constant thickness. Thus, the footprint 16 of the upper beam and the footprint 17 of the lower beam are complementary. When the light sources 5, 6 and 7 are lit, a beam of the high-beam type is obtained. Owing to the non-zero thickness of the beam bender at the cut-off edge, a region of lower illumination is present at the boundary between the two cut-off profiles; this is not a dark region but rather a region of lower light intensity.

Another lighting module 100, similar to that in FIGS. 1 and 2, is illustrated in FIGS. 6 and 7. It is very similar to the module 1 but differs essentially in that it comprises only one upper light source 105, in that the beam bender 108 comprises a complex surface, and in that the upper reflector 102 comprises only one reflecting surface with axis of rotation coinciding with the general optical axis 104 of the module 100. The presence of a single light source associated with the upper reflector means that the illumination of this module is weaker than that of the module 1 in FIGS. 1 and 2. It is designed to be used in combination with the module 1 in order to provide a complementary lighting component. A lower light source 107 is associated with the lower reflector 103.

Figure 8:
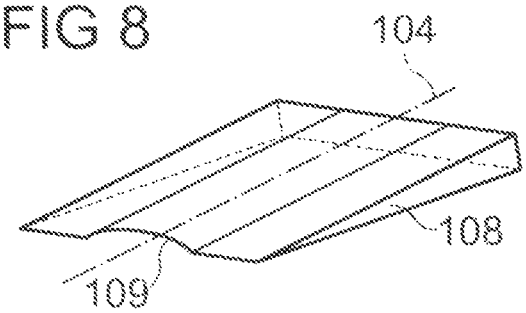
FIG. 8 is a perspective view of the beam bender of the module in FIGS. 6 and 7.

The beam bender 108 is better illustrated in FIG. 8. It is slightly bulging upwards towards the cut-off edge. It has a complex surface on two upper and lower faces. Seen face on from the lens 120, the beam bender presents a profile that bulges upwards, approximately centered on the optical axis and symmetric at the cut-off edge. The cut-off edge is situated at the focal point 113, which corresponds to the second focal point of the upper reflector 102 and of the lower reflector 103. This bulging profile progressively decreases from the cut-off edge 109 towards the back edge of the beam bender. The back part of the beam bender is thus essentially flat. The width of the bulging strip corresponds to less than a third, preferably less than a quarter, of the total width of the beam bender. The cut-off edge 109 exhibits however a generally rectilinear profile seen from above.

FIG. 4 is also applicable to the module in FIGS. 6 and 7. It is a cross-sectional view through a vertical longitudinal median plane of the lighting module 100 and illustrates the role of the beam bender with respect to the light rays coming from the two light sources 105 and 107.

Figure 9:
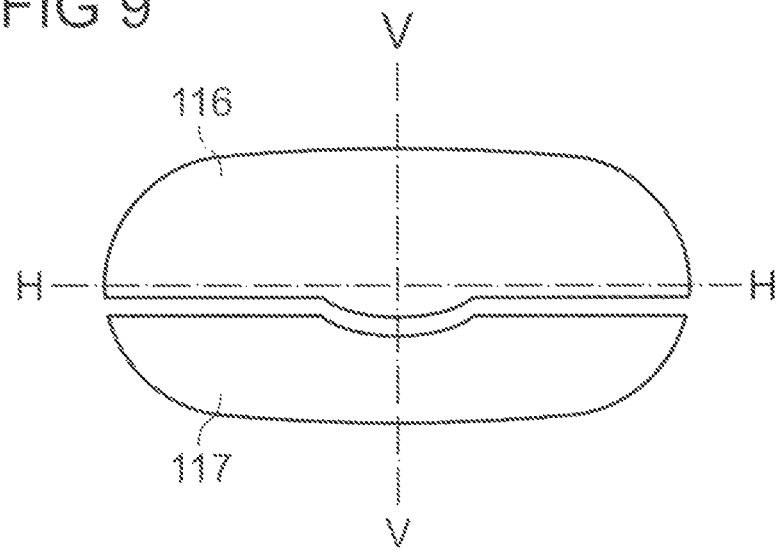
FIG. 9 illustrates the footprint of the beams coming from the upper and lower reflectors, respectively, of the module in FIGS. 6 and 7.

The footprints of the beams projected by the module 100 and emanating from the two light sources 105 and 107 are illustrated in a simplified manner in FIG. 9. The axis H-H corresponds to the horizontal axis and the axis V-V corresponds to the vertical axis.

The footprint of the lower beam 117 is that of the upper light source 105 associated with the upper reflector 102. An essentially horizontal cut-off is observed here that is slightly below the horizon line. The part bulging downwards in the central part of the beam is also observed. It corresponds to the complex shape of the beam bender 108 at the cut-off edge 109. The upper reflecting surface of the beam bender 108 at the cut-off edge is higher than the rest of the surface and hence causes a lower cut-off in correspondence with the bulging profile. The central point of the cut-off edge centered on the optical axis of the module is the highest and thus causes a maximum downwards cut-off corresponding to the intersection of the cut-off edge of the footprint 117 with the vertical axis V-V.

The footprint 116 is that of the lower light source 107 associated with the lower reflector 103. The part bulging downwards is also observed in the central part of the cut-off of the footprint 116 of the upper beam. It corresponds to the complex shape of the beam bender 108 at the cut-off edge 109 of constant thickness. The central point of the cut-off edge centered on the optical axis of the module is the highest and thus causes a minimum downwards cut-off corresponding to the intersection of the cut-off edge of the footprint 116 with the vertical axis V-V. The association of the lower reflector 103 and the lower light source 107, according to the same principle as the lower reflector 3 and the light source 7 of the module 1, thus generates the upper beam 116 with a lower cut-off.

Figure 10:
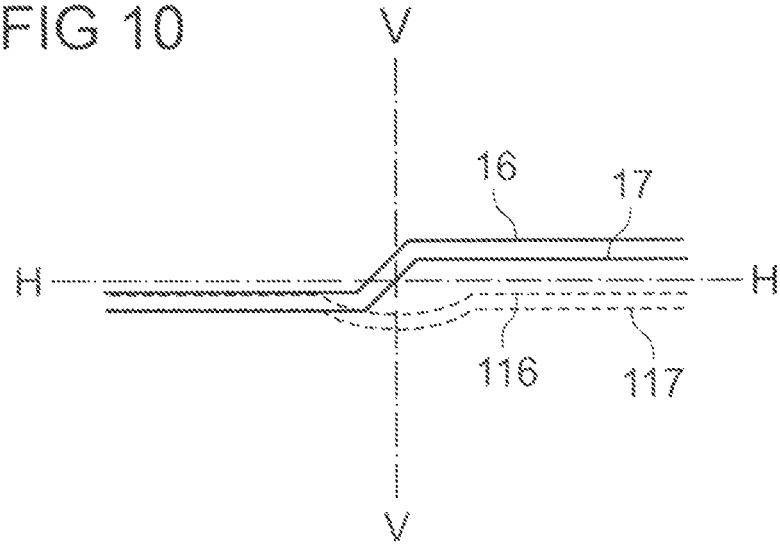
FIG. 10 illustrates the superposition of the beams coming from the upper and lower reflectors of the module according to FIGS. 1 and 2 and of the module according to FIGS. 6 and 7.

FIG. 10 illustrates the superposition of the various beams of the two modules 1 and 100 in the central part of the projected beam. The central part is effectively the most important for the quality of vision of the driver of the vehicle. The respective cut-offs of the beams of the lighting module with beam bender of the first module 1 are illustrated with solid lines. The respective cut-offs of the beams of the low-beam type and of the complementary high-beam type of the lighting module with a complex surface beam bender, the second module 100, are illustrated with dashed lines. It should be noted that these cut-offs are shown very schematically for reasons of clarity of presentation of the invention. Moreover, the region included between the corresponding cut-offs of the lower footprints and of the upper footprints of a lighting module is not totally absent from illumination. The region in question however exhibits, at the very least, an irregularity or non-uniformity in illumination which causes a particular problem in the central part. The presence of the beam 117 of lower power (a single light source for the module with complex beam bender as opposed to two for the module with beam bender with the protrusion 12) constitutes a reinforcement of the beam 17 while at the same time complying with the stepped cut-off required by the legislation. The superposition of the beams 17 and 117 forms the low-beam function of the device comprising a module according to FIGS. 1 and 2 and a module according to FIGS. 6 and 7. The lighting function of the high-beam type is provided by the superposition of the beams 17, 117, 16 and 116. It is observed in FIG. 10 that the beam 116, potentially with power similar to the beam 16, is used to complete it while at the same time covering the central part of the region of non-uniformity. The result of this is a high-beam function that is improved from the point of view of the uniformity of the beam, in particular in the central part. Moreover, the bulging shape of the cut-off induced by the beam bender with complex surface is chosen to be sufficiently wide to cover the central part important for the quality of vision of the driver. The fact that this bulging part sufficiently covers the central stepped part of the beams of the first module affords a certain freedom in the adjustment of the two modules with respect to one another as regards the convergence of their beams.

It should be noted that other power levels for the beams may be considered. The choice of a module with three light sources for the beam bender with protrusion and a module with two light sources for the beam bender with complex surface is purely by way of example. For example, the module using a beam bender with protrusion could have two light sources. A module using beam bender with protrusion could also be combined with two modules using complex beam benders.

FIG. 11 illustrates by isolux curves the luminosity of the various projected beams at 25 meters. The beam (b) corresponds to the beam of the low-beam type from the upper reflector 2 of the first module 1. It corresponds to the footprint 17 in FIG. 5. The beam (a) corresponds to the complementary beam from the lower reflector 3 of the first module 1. It corresponds to the footprint 16 in FIG. 5. The beam (c) corresponds to the superposition of the two beams.

The beam (e) corresponds to the lower beam from the upper reflector 102 of the second module 100, this being the footprint 117 in FIG. 9. The beam (d) corresponds to the upper beam from the lower reflector 103 of the second module 100, this being the footprint 116 in FIG. 9. The beam (f) corresponds to the superposition of the two beams (e) and (d). The beam (g) corresponds to the superposition of the combined beams (c) and (f) from the two lighting modules 1 and 100. This beam (g) corresponds to a high beam. It is observed that the illumination irregularities are corrected by the combination of the beams from the two modules. The curvature rounded downwards of the lower cut-off of the beam (d), in other words corresponding to the lower reflector 103 of the second module 100, allows the illumination in the central region to be reinforced in high beam mode.

It should be noted that, in order to obtain a low-beam, or "dipped", headlight, only the upper light sources 105 and 5 and 6 are lit. The beams (b) and (e) are then superposed. Owing to the cut-off curved downwards for the beam (e) from the upper reflector 102 of the second module, there is no problem of alignment of the cut-offs in the central region of the low-beam beam.

FIG. 12 illustrates a lighting unit 202 for generating a light beam with cut-off, notably for a low-beam headlamp for motor vehicles, this lighting unit comprising:

a first reflector 2 comprising at least two reflection faces 2*a* and 2*b*, each having a first focal point F1 and F2 and a second focal point 13 aligned on an optical axis 31, 30, each face being capable of reflecting the light rays leaving from its first focal point F1 and F2 towards its second focal point 13, the optical axes 31, 30 of the two reflection faces 2*a* and 2*b* intersecting at their second focal points 13;

a shield 8 configured for creating a cut-off in the light beam generated by the lighting unit;

an optical element 20 comprising a first focal point FL situated on the cut-off edge 9 of the shield, the reflection faces 2*a* and 2*b* of the first reflector, the shield 8 and the optical element 20 being configured in such a manner as to allow the generation of a light beam with cut-off.

The optical element 20 of the lighting unit 202 is a converging lens, admitting a focal point FL positioned on the cut-off edge of the shield.

The angle between the optical axes 31, 30 of the two reflection faces 2*a* and 2*b* of the first reflector 2 is an angle $\alpha$ in the range between 20 and 40 degrees, preferably between 25 and 37 degrees, notably 31 or 35 degrees.

Each reflection face 2*a* and 2*b* of the first reflector 2 is included in a portion of ellipsoid, the two portions of ellipsoids intersecting along a line of separation 2*c* separating the two reflection faces. The form of this portion may not strictly be that of an ellipsoid and may be approximately ellipsoidal. Advantageously, the two reflection faces 2*a* and 2*b* meet at the said line of separation 2*c*.

Two light-emitting diodes 6 and 5 are positioned at the first focal points of each of the reflection faces 2*a* and 2*b*. Each light-emitting diode 5, 6, comprises a reference axis 5*a*, 6*a*, these reference axes of the light-emitting diodes making an angle $\beta$ between them different from the angle $\alpha$ that the optical axes 31, 30 of the reflection faces 2*a* and 2*b* of the first reflector 2 make between them. In this example, the reference axes 5*a* and 6*a* correspond, for these LEDs 5 and 6, to the axis passing through the corresponding LED and perpendicular to one of the large sides 5*b*, 6*b* of the emitting surface of the LED, this emitting surface being rectangular.

This lighting unit can be used in a module previously described. A lighting module 1 according to the first subject of the invention, illustrated in FIGS. 1 to 4, can thus be one in which the first reflector 2, the shield 8 and the optical element 20 are a lighting unit 202 such as previously described. Advantageously, the second reflector 3 of this module 1 comprises a light-emitting diode 7, situated at the first focal point of the second reflector 3 and situated underneath the optical axis 4 of the module, notably 11 mm below the optical axis.

While the system and apparatus herein described constitute preferred embodiments of this invention, it is to be understood that the invention is not limited to this precise system and apparatus, and that changes may be made therein without departing from the scope of the invention which is defined in the appended claims.

What is claimed is:

1. A lighting module for motor vehicles comprising:

a first concave reflector comprising at least a first focal point and a second focal point aligned on an optical axis of said first concave reflector, in such a manner that a majority of light rays leaving from said first focal point and reflected by said first concave reflector converge towards said second focal point;

a second concave reflector and comprising at least a first focal point and a second focal point aligned on an optical axis of said second concave reflector, in such a manner that a majority of light rays leaving from said first focal point and reflected by said second concave reflector converge towards said second focal point, said first and said second concave reflectors having a truncated circumference in such a manner that a reflecting face of said first concave reflector is oriented towards that of said second concave reflector;

a shield disposed within a plane between said first and said second concave reflectors, said shield having a first face facing said reflecting face of said first concave reflector and a second face facing a reflecting surface of said second concave reflector, said shield comprising a cut-off edge joining its first and its second face; and an optical element comprising a first focal point situated in a plane perpendicular to an optical axis of said lighting module and passing through said cut-off edge;

said cut-off edge being situated at said second focal point of said first concave reflector and at said second focal point of said second concave reflector, and in that said first concave reflector of said lighting module comprises two intersecting reflection surfaces, each being a surface of revolution described by an ellipse in a half-plane having a first focal point and a second focal point aligned on an optical axis, said optical axes of said two intersecting reflection surfaces of revolution intersecting at said second focal point.

2. The lighting module according to claim 1, in which said first concave reflector, said shield and said optical element are lighting units.

3. The lighting module according to claim 2, in which said second concave reflector comprises a light-emitting diode, situated at said first focal point of said second concave reflector and situated 11 mm below said optical axis.

4. A lighting module for motor vehicles comprising:

a first concave reflector comprising at least a first focal point and a second focal point aligned on an optical axis of said first concave reflector, in such a manner that a majority of light rays leaving from said first focal point and reflected by said first concave reflector converge towards said second focal point;

a second concave reflector comprising at least a first and a second focal point aligned on an optical axis of said second concave reflector, in such a manner that a majority of light rays leaving from said first focal point and reflected by said second concave reflector converge towards said second focal point, said first and said second concave reflectors having a truncated circumference such that a reflecting face of said first concave reflector is oriented towards that of said second concave reflector;

a shield disposed in a plane between said first and said second concave reflectors, said shield having a first face facing a reflecting surface of said first concave reflector and a second face facing a reflecting surface of said second concave reflector, said shield comprising a cut-off edge joining its first and its second face; and an optical element comprising a first focal point situated in a plane perpendicular to an optical axis of said lighting module and passing through said cut-off edge;

said cut-off edge being situated at said second focal point of said first concave reflector and at said second focal point of said second concave reflector, and in that said shield comprises at least on said cut-off edge a profile curved in a plane perpendicular to an optical axis of said lighting module, so as to affect in a corresponding manner a cut-off of a beam coming from one of said first and said second concave reflectors.

5. The lighting module according to claim 4, wherein said curved profile is centered globally on said optical axis of said lighting module.

6. The lighting module according to claim 4, wherein an edge of said shield has a constant thickness, such that a curved profile is present on two reflecting and opposed surfaces of said shield.

7. The lighting module according to claim 4, wherein said curved profile is limited to a central part of said shield, the rest being essentially flat.

8. The lighting module according to claim 4, wherein said first face of said shield and said second face of said shield meet at a cut-off edge, and in that said second focal point of said first and of said second concave reflectors coincide at a second common focal point, said cut-off edge being positioned at said second common focal point.

9. The lighting module according to claim 4, wherein at least one of said first and second faces of said shield are reflecting.

10. The lighting module according to claim 4, wherein it comprises a first light source situated approximately at said first focal point of said first concave reflector and a second light source situated approximately at said first focal point of said second concave reflector, said first light source only illuminating in the direction of said first concave reflector and said second light source only illuminating in the direction of said second concave reflector.

11. The lighting module according to claim 10, wherein said first light source comprises an LED emitting in a general direction oriented towards said first concave reflector, and in that said second light source comprises an LED emitting in a general direction oriented towards said second concave reflector.

12. The lighting module according to claim 10, wherein said first and second light sources are carried by said shield, said first light source on said first face of said shield and said second light source on said second face of said shield.

13. A lighting device for motor vehicles comprising:

a first lighting module comprising a first lighting function of the low-beam type;

a second lighting module according to claim 4, said first and second lighting modules being disposed next to one another in such a manner that their beams converge.

14. The lighting device according to claim 13, wherein:

said first lighting module is a module comprising said cut-off edge of said first lighting module having two straight parts offset with respect to one another by a protrusion situated in a central part of said cut-off edge, in order to form, in association with the rays reflected by said first concave reflector of said first lighting module, a first beam of low-beam type having an oblique cut-off portion;

said second lighting module is a module comprising said curved profile of said cut-off edge being centered globally on said optical axis of said second lighting module, so as to form, in association with the rays reflected by said first concave reflector of said second lighting module, a second beam exhibiting an upper cut-off with a curved profile oriented downwards;

said first and second lighting modules being oriented in such a manner that the oblique portion of the cut-off of said first beam converges towards the curved profile of the beam of said second beam.

15. The lighting device according to claim 14, wherein said second lighting module comprises a cut-off edge of constant thickness, such that said second concave reflector of said second lighting module allows a third beam to be generated that exhibits a lower cut-off with a complementary curvature to the curvature of the upper cut-off of said second beam.

16. The lighting device according to claim 13, wherein said first concave reflector of said first lighting module comprises two intersecting reflection surfaces, each being a surface of revolution described by an ellipse in a half-plane having a first and a second focal point aligned on an optical axis, said optical axes of said two intersecting reflection surfaces of revolution intersecting at said second focal point.

17. A lighting unit for generating a beam with cut-off for motor vehicles, said lighting unit comprising:

a first reflector comprising at least two reflection faces, each having a first focal point and a second focal point, respectively, aligned on an optical axis, each of said at least two reflection faces being capable of reflecting the light rays leaving from said first focal point towards said second focal point, said optical axes of said at least two reflection faces intersecting at said second focal points;

a shield configured for creating a cut-off in the light beam generated by said lighting unit;

an optical element comprising a first focal point (FL) situated on the cut-off edge of the shield, said at least two reflection faces of said first reflector, said shield and said optical element being configured in such a manner as to allow the generation of a light beam with cutoff;

said lighting unit further comprising a first light-emitting diode positioned at said first focal point of one of said at least two reflection faces and a second light-emitting diode positioned at said first focal point of the other reflection face.

18. The lighting unit according to claim 17, in which each light-emitting diode comprises a reference axis, these reference axes of said light-emitting diode making an angle ($\beta$) between them different from an angle ($\alpha$) made between said optical axes of said at least two reflection faces of said first reflector.

19. The lighting unit according to claim 17, in which said optical axes of said at least two reflection faces of said first concave reflector make an angle ($\alpha$) between them in the range between 20 and 40 degrees.

20. The lighting unit according to claim 19, wherein said angle is between 25 and 37 degrees.

21. The lighting unit according to claim 19, wherein said angle is between 31 and 35 degrees.

22. The lighting unit as recited in claim 17, wherein said light beam with cut-off is a low beam.

* * * * *